US005718086A

United States Patent [19]

Dunn

[11] Patent Number: 5,718,086

[45] Date of Patent: Feb. 17, 1998

[54] METHOD AND APPARATUS FOR CONTINUOUS SOFFIT VENTING

[76] Inventor: George A. Dunn, 267 Wyckoff Rd., Eatontown, N.J. 07724

[21] Appl. No.: 661,095

[22] Filed: Jun. 10, 1996

[51] Int. Cl.[6] ..... F04D 3/40

[52] U.S. Cl. ..... 52/95; 52/94; 52/302.3; 454/260; 454/339; 454/354; 454/367

[58] Field of Search ..... 52/94, 95, 198, 52/199, 302.1, 302.3; 454/260, 270, 271, 254, 339, 354, 366, 367

[56] References Cited

U.S. PATENT DOCUMENTS

| | | | |
|---|---|---|---|
| 3,125,942 | 3/1964 | Smith | 454/260 |
| 3,174,421 | 3/1965 | Gray | 454/260 |

FOREIGN PATENT DOCUMENTS

| | | | |
|---|---|---|---|
| 2115920 | 9/1983 | United Kingdom | 454/260 |
| 2162632 | 2/1986 | United Kingdom | 454/260 |
| 2190740 | 11/1987 | United Kingdom | 454/260 |

*Primary Examiner*—Carl D. Friedman
*Assistant Examiner*—Timothy B. Kang
*Attorney, Agent, or Firm*—Robert M. Skolnik

[57] ABSTRACT

A continuous vent in the form of a resilient apertured trough which fits into a bevel in the center of the soffit or at the fascia or the wall. The advantages of the vent is that its hold is based on its shape, its resilience and the angle of the bevel in the soffit. The vent is used in existing soffits or on new construction. The method involves the steps of venting a soffit by cutting two beveled ends a few inches apart and inserting a resilient apertured vent in the space between the bevels. For new construction, one beveled strip is temporarily adhered via an adhesive to hold the vent in place until the second bevel is completed and both beveled pieces are installed.

12 Claims, 5 Drawing Sheets

METHOD AND APPARATUS FOR CONTINUOUS SOFFIT VENTING

BACKGROUND OF THE INVENTION

1. Field of the Invention

The present invention relates to a method and apparatus for continuous soffit venting. The invention takes the form of a resilient apertured trough which fits into a bevel in the center of the soffit, at the fascia, or at the wall.

2. Description of the Related Art

The venting of soffits is taught in several prior art patents.

Morell, U.S. Pat. No. 2,664,809 shows an air vent tube for insertion in the wall.

Malm, U.S. Pat. No. 2,709,402, discloses a ventilator similar to Morell.

Tegarty, U.S. Pat. No. 2,764,929, is another insertable ventilator.

Riggle, U.S. Pat. No. 2,789,493, drills a number of through holes in the structure and covers the holes with a protective screen and a covering.

Wilder, U.S. Pat. No. 2,840,867 drives a nail with a housing into the wall and withdraws the nail leaving the housing.

DeSchane, U.S. Pat. No. 4,565,037 shows a soffit vent 22 working with an insulation support in the attic.

Quinnell, U.S. Pat. No. 4,580,374, installs one or more rectangular preformed vents in a soffit formed between a clip at the fascia and the wall.

Speer, U.S. Pat. No. 4,702,149 vents with a plurality of tubes to vent the space underneath a soffit.

SUMMARY OF THE INVENTION

The invention includes a vent in the form of a resilient apertured trough which fits into a bevel in the center of the soffit or at the fascia or the wall. The advantages of the vent is that its hold is based on its shape, its resilience and the angle of the bevel in the soffit. The invention works on existing soffits or on new construction. The method involves the steps of venting a soffit by cutting two beveled ends a few inches apart and inserting a resilient apertured vent in the space between the bevels. For new construction, one beveled strip is temporarily adhered via adhesive to hold the vent in place until the second bevel is completed and both beveled pieces are installed.

The invention is used where ventilation of building structures, such as residences is required to prevent a build up of moisture in unoccupied portions of the building.

A principal object and advantage of the invention is the provision of a continuous vent for an attic space of a building. Another object and advantage of the invention is the provision of a continuous vent for attic space which can be installed on new construction or onto existing buildings. A still further object and advantage of the invention is the provision of a continuous bend which is designed to be installed in the soffit. Another object and advantage of the invention is the provision of a continuous vent which is mounted centrally in the soffit. A still further object and advantage of the invention is the provision of a continuous soffit vent which mounts in the soffit adjacent wall of the building. Another object and advantage of the invention is the provision of a continuous vent which mounts in the soffit adjacent the building's fascia. A still further object and advantage of the invention is the provision of a continuous soffit vent that is held in place by the shape of the vent.

Another object and advantage of the invention is the provision of a continuous soffit which is held in place by its resilience. Another object and advantage of the present invention is the provision of a continuous soffit vent which is held in place by the angle of the bevel in the soffit.

A still further object and advantage of the invention is the provision of a method of venting a soffit by cutting two beveled ends a few inches apart in the soffit and inserting a resilient apertured vent in the space between the bevels. A still further object and advantage of the method of the invention is the provision of a method of continuously venting a soffit in new construction where one beveled strip is temporarily held in place with an adhesive until the second bevel is completed and both beveled pieces are installed. Another object and advantage of the invention is the provision of a continuous vent which is snapped into position. A still further object and advantage of the invention is the provision of a snap in vent which maintains its location without the need for nails, staples or other fasteners.

The foregoing, as well as further objects and advantages of the invention will become apparent to those skilled in the art from a review of the following detailed description of my invention, reference being made to the accompanying drawings.

DETAILED DESCRIPTION OF THE PREFERRED EMBODIMENTS

Figure 1:
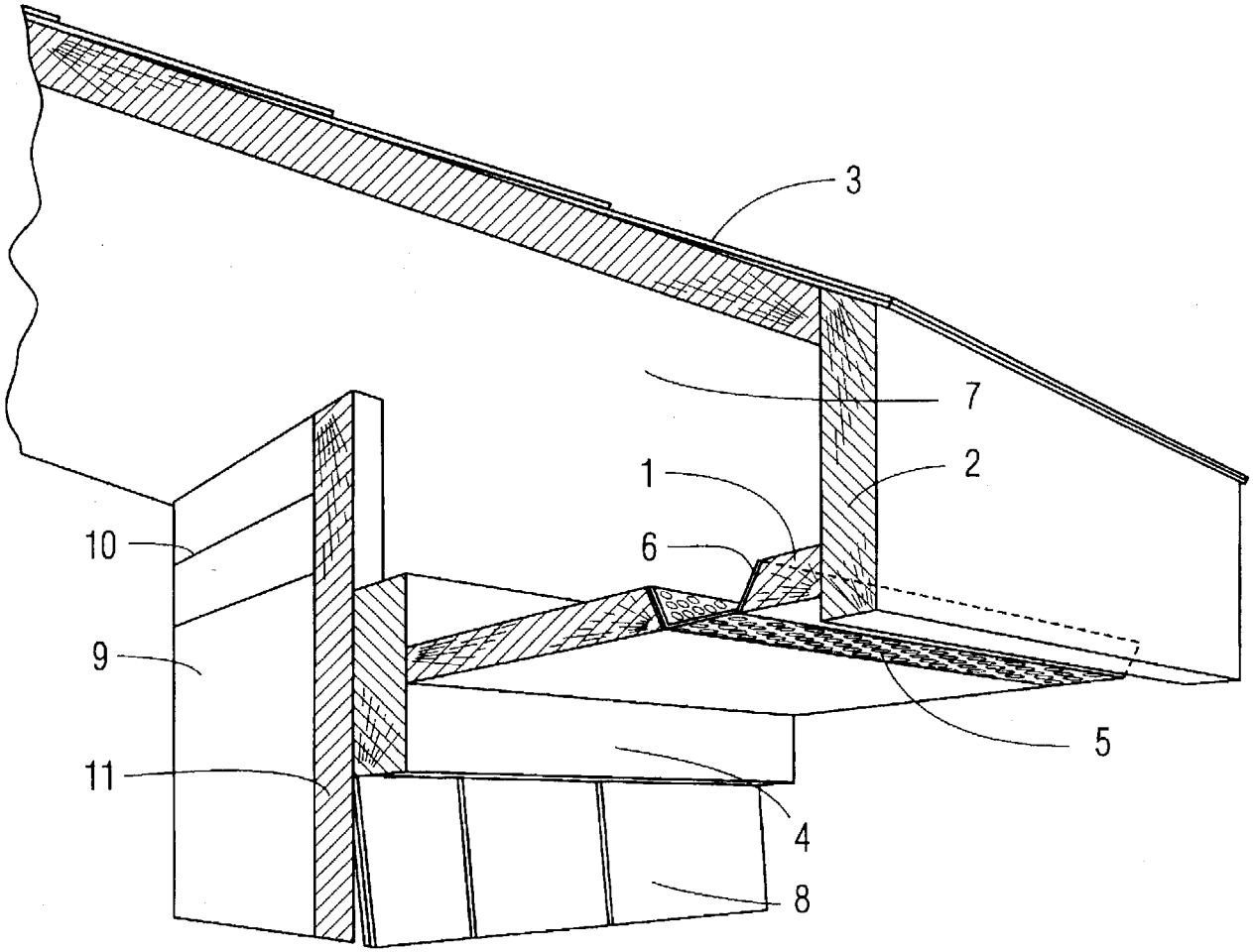
FIG. 1 is perspective view of my invention mounted centrally in a soffit.

As shown in FIGS. 1–6, where like reference numerals are used to designate like parts, a continuous vent 5 is mounted at different locations in soffit 1. Vent 5 may be perforated or slotted. Vent 5 is formed of a flexible material in the trapezoidal shape shown in FIGS. 1–6. The vent 5 is designed to snap in to the special bevel in soffit 1.

The soffit 1 is formed between the fascia 2 and the wall 4. The fascia 2 and wall 4 form parts of a building structure which may include the usual construction elements such as a roof 3, roof rafter 7, exterior siding 8, studs 9, plate 10 and sheathing 11.

Figure 2:
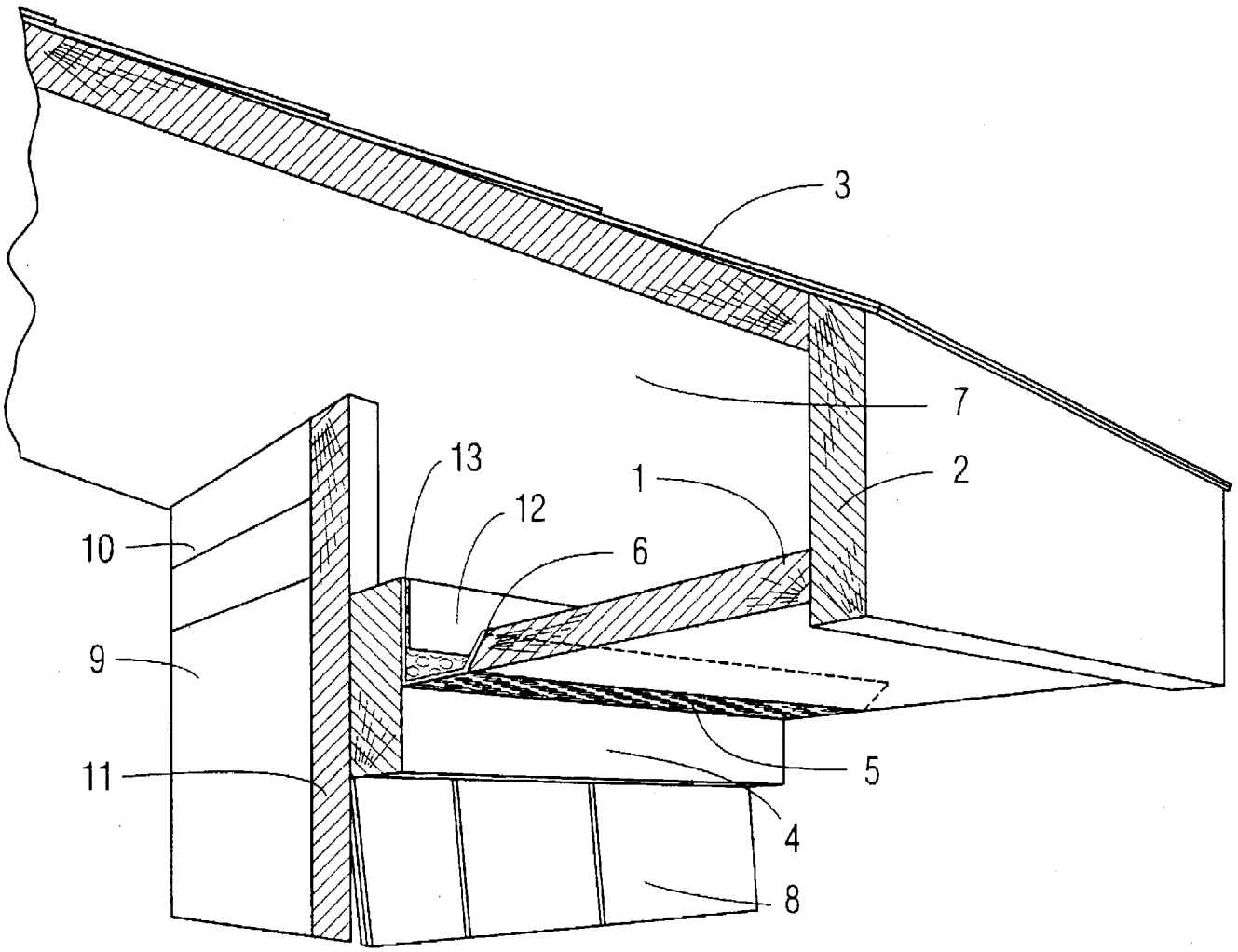
FIG. 2 is a perspective view of my invention mounted in a soffit adjacent a structure's wall.
Figure 3:
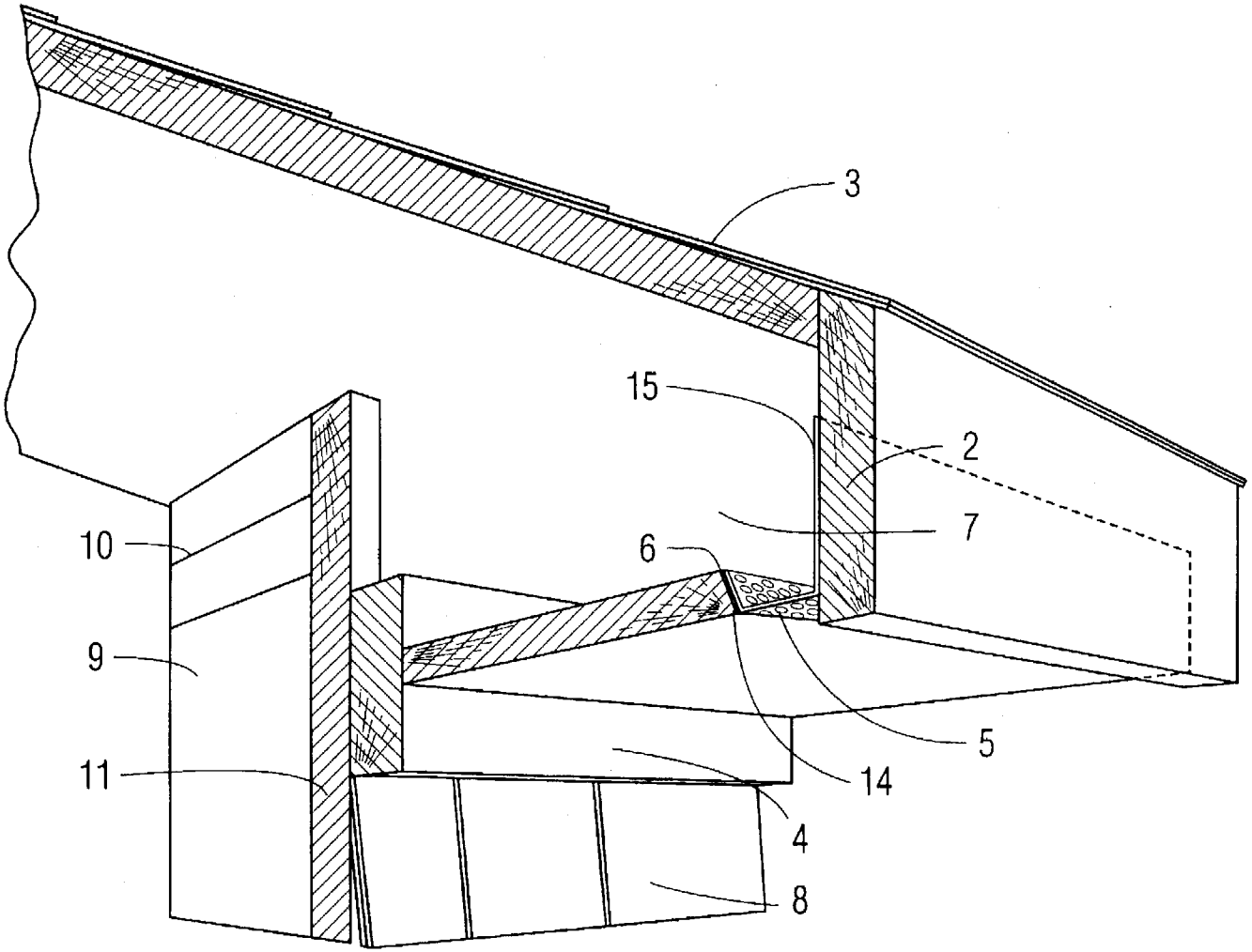
FIG. 3 is a perspective view of my invention mounted in a soffit adjacent a structure's fascia.
Figure 4:
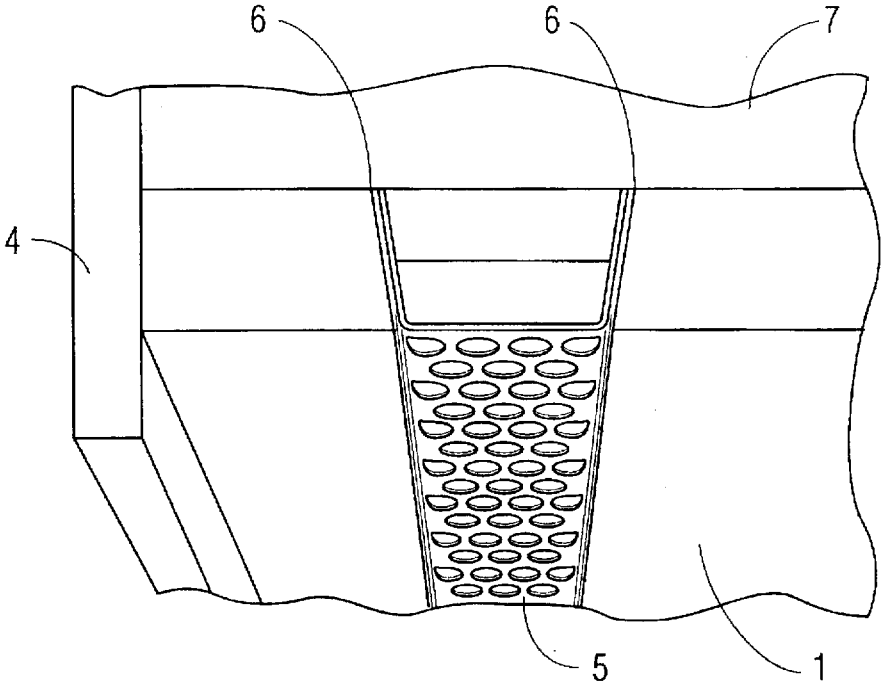
FIG. 4 is a perspective view of a portion of FIG. 1.
Figure 5:
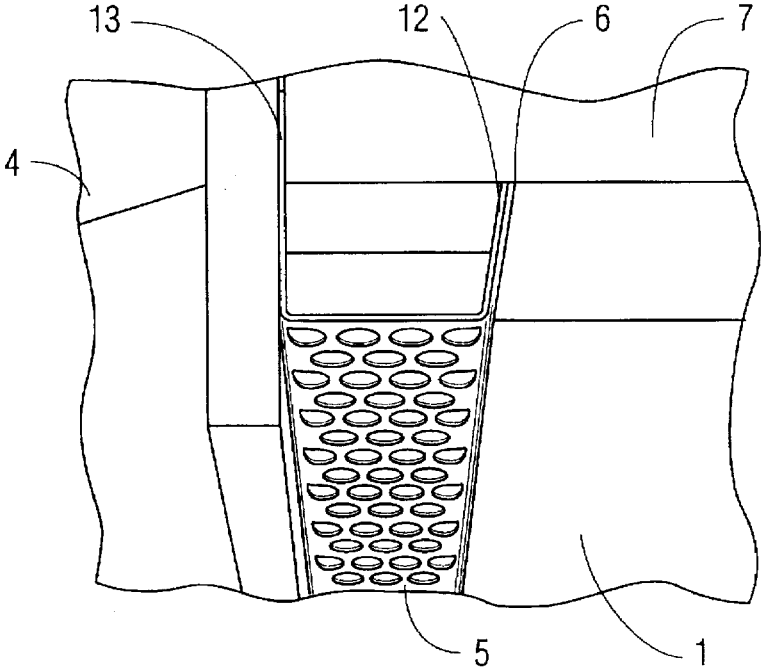
FIG. 5 is a perspective view of a portion of FIG. 2.

The soffit 1 in FIG. 1 is angularly bevel at 6 in two portions when the vent is to be mounted centrally in the soffit 1. The angle of the bevel 6 is chosen to match the angle of the walls of the vent 5. When the vent 5 is to be mounted adjacent the wall of a building structure as shown in FIG. 2, only a single angle bevel 6 is required. Similarly, when the vent 5 is to be mounted adjacent the fascia of a building structure as shown in FIG. 3, a single angular bevel 6 is also employed. The vent 5 in FIGS. 2 and 3 is formed having one angled portion 12 and one straight portion 13. The straight portion 13 is mounted adjacent the wall or fascia as the case may be between the soffit and the roof rafter.

Similarly, vent 5 may have an angle portion 14 and a straight portion 15 when the vent is mounted to the fascia 2 as shown in FIG. 3.

If required, a layer of adhesive may be employed to temporarily hold the vent 5 against one of the angle bevels 6, the building wall 4 or the fascia 2. More particularly, during installation, a section of vent 5 may be adhesively engaged to the bevel 6, wall 4 or fascia 2 while the installer is performing other operations such as forming another part of the soffit 1 or otherwise constructing the rafter, roof, or sheathing or, for new construction, to hold the vent in place until the second bevel is completed and both beveled pieces are installed.

Figure 6:
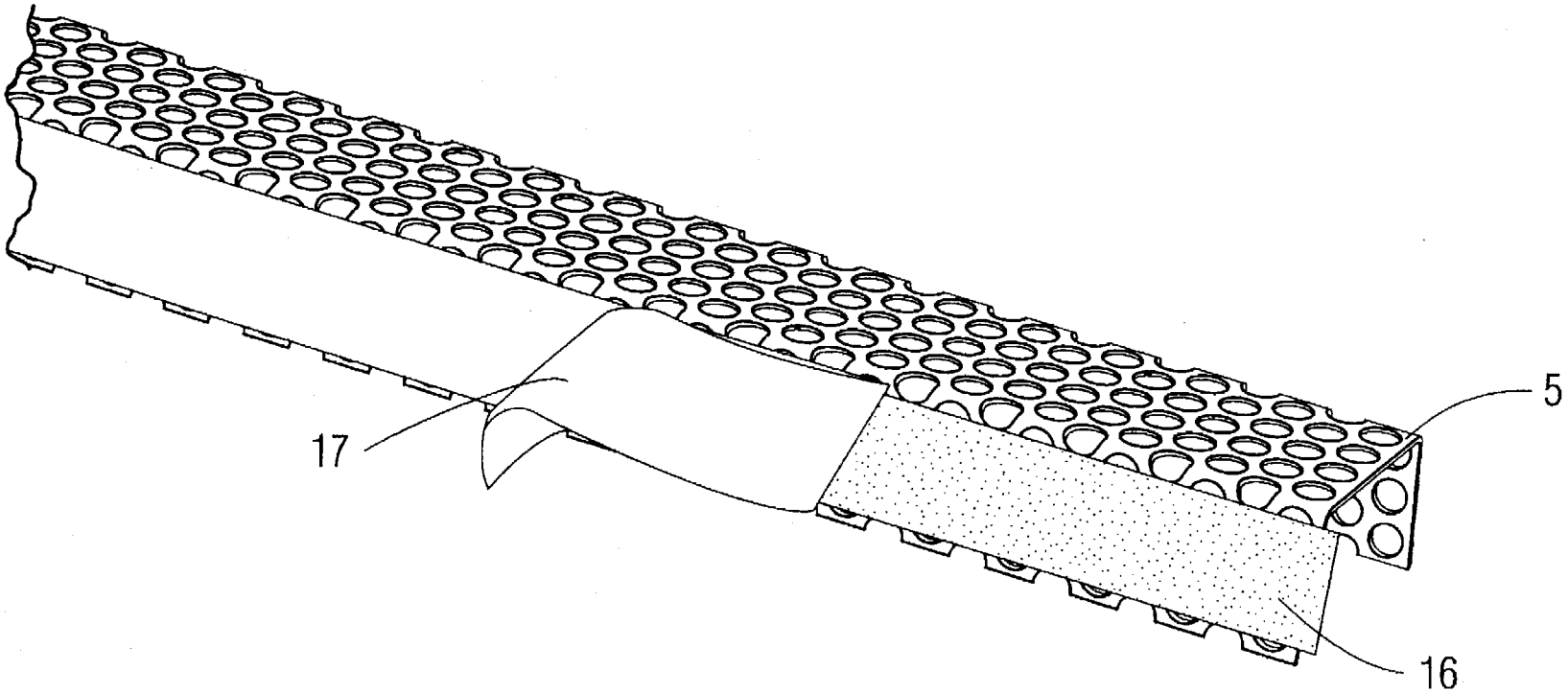
FIG. 6 is a perspective view of the vent portion of FIG. 1 with a pre-applied adhesive.

FIG. 6 illustrates the vent 5 having a pre-applied adhesive 16 on one of the angle bevels thereof. The adhesive 16 may be covered by a removable protective strip 17. In use, strip 17 is peeled away to expose the adhesive 16.

Further modifications to the method and apparatus of the invention may be made without departing from the spirit and scope of the invention; accordingly, what is sought to be protected is set forth in the appended claims.

What is claimed is:

1. In combination, a continuous vent and a building structure, said building structure including a soffit, a wall and fascia, said continuous vent comprising: a resilient apertured trough, said trough having a bottom portion and two wall portions; said trough being connected to the soffit of said building structure; said soffit having at least one angular bevel along a substantial length of said soffit, the angle of said bevel corresponding to the angle of one of said wall portions relative to said bottom portion, the other of said wall portions of said trough being connected to a second angular bevel in said soffit, or to the wall of said building structure or to the fascia of said building structure said trough being held in said soffit solely by the force exerted by said resilience on said bevel.

2. A method of venting the soffit of a building structure comprising the steps of forming a flexible apertured trough with a bottom portion and two wall portions at least one of said wall portions being formed at an obtuse angle with respect to said bottom portion; installing said trough portion in said soffit by beveling said soffit at an angle corresponding to said obtuse angle; and affixing one of said wall portions of said trough to said bevel in said soffit to hold said trough in said soffit solely by compressing said flexible trough against said bevel.

3. The method of claim 2 wherein the other of said wall portions is formed at an obtuse angle with respect to said bottom portion; further including the steps of beveling said soffit at a second obtuse angle spaced from said first bevel and mounting said trough between said bevels with the wall portions of said trough contacting said bevels.

4. In the method of claim 2, wherein said building structure includes a fascia, further including the step of affixing the other of said wall portions of said trough to said fascia of said building structure.

5. The method of claim 2, wherein said building structure includes a wall, further including the step of affixing the other of said wall portions of said trough to said wall of said building structure.

6. In a building structure having a soffit, a wall and fascia, a continuous vent for said building structure comprising: apertured trough means formed of a flexible material, said trough means having a bottom and first and second walls, said first wall being formed at an obtuse angle with respect to said bottom; said first wall being affixed to a bevel in said soffit, the angle of said bevel being the same as said obtuse angle; said second wall of said apertured trough means being formed perpendicular to said bottom, said second wall being affixed to said wall or said fascia said trough being held in said soffit solely by said flexibility and said angle.

7. In a building structure having a soffit having an exterior surface, a wall and fascia, a continuous vent for said building structure comprising: apertured trough means formed of a flexible material, said trough means having a bottom and first and second walls, said first and second walls being formed at equal obtuse angles with respect to said bottom; said first and second walls being affixed to bevels in said soffit, the angle of said bevels being the same as said obtuse angle, to support said trough means in said soffit so that said bottom is substantially coplanar with the exterior surface of said soffit, said trough means being held in said soffit solely by said flexibility and said angles.

8. A method of supporting a vent in the soffit of a building structure comprising the steps of: forming a resilient apertured vent having at least one angular wall portion; beveling at least one beveled end in the soffit of a building structure at an angle corresponding to said angular wall portion; and connecting said resilient apertured vent to said beveled end to support said resilient apertured vent in said soffit solely by said resilience and said angles.

9. The method of claim 8 wherein said resilient apertured vent has another angular wall portion, further including the step of beveling another beveled end in said soffit a few inches from said first beveled end and inserting said resilient apertured vent in the space between the bevels.

10. The method of claim 9 further including the step of temporarily adhering said vent to one of said beveled ends with an adhesive for holding said vent in place until the second bevel is completed and both bevels are installed.

11. The method of claim 8 further including the step of locating said beveled end in proximity to the fascia of a building structure and connecting said vent between said beveled end and said fascia.

12. The method of claim 8 further including the step of locating said beveled end in proximity to the wall of a building structure and connecting said vent between said beveled end and said wall.

* * * * *